United States Patent [19]

Kratz et al.

[11] 4,023,129

[45] May 10, 1977

[54] DEFLECTION YOKE WITH NON-RADIAL CONDUCTORS

[75] Inventors: Jerrold Kerwin Kratz; Edward Walter Christensen, II, both of Indianapolis, Ind.

[73] Assignee: RCA Corporation, New York, N.Y.

[22] Filed: Apr. 14, 1975

[21] Appl. No.: 567,968

[52] U.S. Cl. ..... 335/210; 335/213

[51] Int. Cl.[2] ..... H01F 7/00

[58] Field of Search ..... 335/210, 213

[56] References Cited

UNITED STATES PATENTS

| | | | |
|---|---|---|---|
| 3,601,731 | 8/1971 | Christiana | 335/213 X |
| 3,711,802 | 1/1973 | Torsch | 335/213 X |
| 3,758,888 | 9/1973 | Kodota | 335/210 |
| 3,801,941 | 4/1974 | Phillips | 335/213 X |
| 3,878,490 | 4/1975 | Logan | 335/213 X |
| 3,895,329 | 7/1975 | Logan et al. | 335/213 X |

*Primary Examiner*—George Harris
*Assistant Examiner*—Fred E. Bell
*Attorney, Agent, or Firm*—Eugene M. Whitacre; Paul J. Rasmussen

[57] ABSTRACT

A deflection yoke includes a core having front and rear grooved end caps for securing conductor turns at the front and rear of the yoke. A third set of conductor grooves is disposed on the inside of the core at a position between the front and rear end caps for securing conductor turns at that position for forming precision-disposed non-radial active turns. The coils formed by the conductor turns may be toroidal or saddle, depending on the return conductor disposition.

5 Claims, 5 Drawing Figures

DEFLECTION YOKE WITH NON-RADIAL CONDUCTORS

BACKGROUND OF THE INVENTION

This invention relates to precision deflection yokes having conductor turns thereof disposed in a non-radial manner relative to the central longitudinal axis of the yoke.

It is recognized that as multi-beam color television picture tubes are utilized which have increasingly wider deflection angles, the effects of the deflection yoke on beam and raster distortion become greater. This situation exists for both in-line and delta configurations of the electron gun structure within the picture tubes. Because the characteristics of a deflection yoke can do much to upset a desired convergence condition of the beams or distort the scanned raster on the viewing screen of the picture tube, it has been recognized in the prior art that these characteristics also may be controlled such that the deflection yoke itself is utilized to aid the convergence of the beams and the formation of a satisfactory raster. To this end, in saddle type deflection coils the lumped active side conductors have had their cross-sectional distribution changed front to rear and the shape of the coil window has been altered. However, great precision in the winding of saddle type coils has heretofore not been achieved because each conductor turn may lie in a number of arbitrary positions as the coil is wound. Thus, with saddle coils it has been common practice to utilize relatively complex apparatus in addition to the yoke to achieve satisfactory convergence and raster condition. In contrast to saddle type coils, toroidally wound coils have been developed which have great precision in the placement of each conductor by the utilization of grooved rings at the front and rear end portions to hold the conductors in place. Each of these conductors lies in a plane determined by the grooves which hold the conductor at the front and rear end portions of the yoke. By suitable spacing, layering and interleaving the conductors, a yoke which has good repeatability in production and which provides satisfactory performance can be built. However, it has been necessary in most instances to utilize additional convergence and raster correction apparatus even with these precision toroids. What is desired is a precision wound deflection yoke which gives the yoke designer a greater degree of freedom in designing a yoke which results in the elimination of or reduction in the amount of convergence or raster correction apparatus required to be utilized in conjunction with the yoke.

SUMMARY OF THE INVENTION

A deflection yoke includes a core with first and second sets of grooves disposed at front and rear portions thereof for securing conductor turns at the front and rear of the core. A third set of grooves is disposed about the inside of the core between the front and rear portions for securing conductor turns at an intermediate point of the core along its longitudinal axis for forming precision-disposed non-radial conductor turns.

A more detailed description of the invention is given in the following description and accompanying drawings of which:

DESCRIPTION OF THE INVENTION

Figure 1:
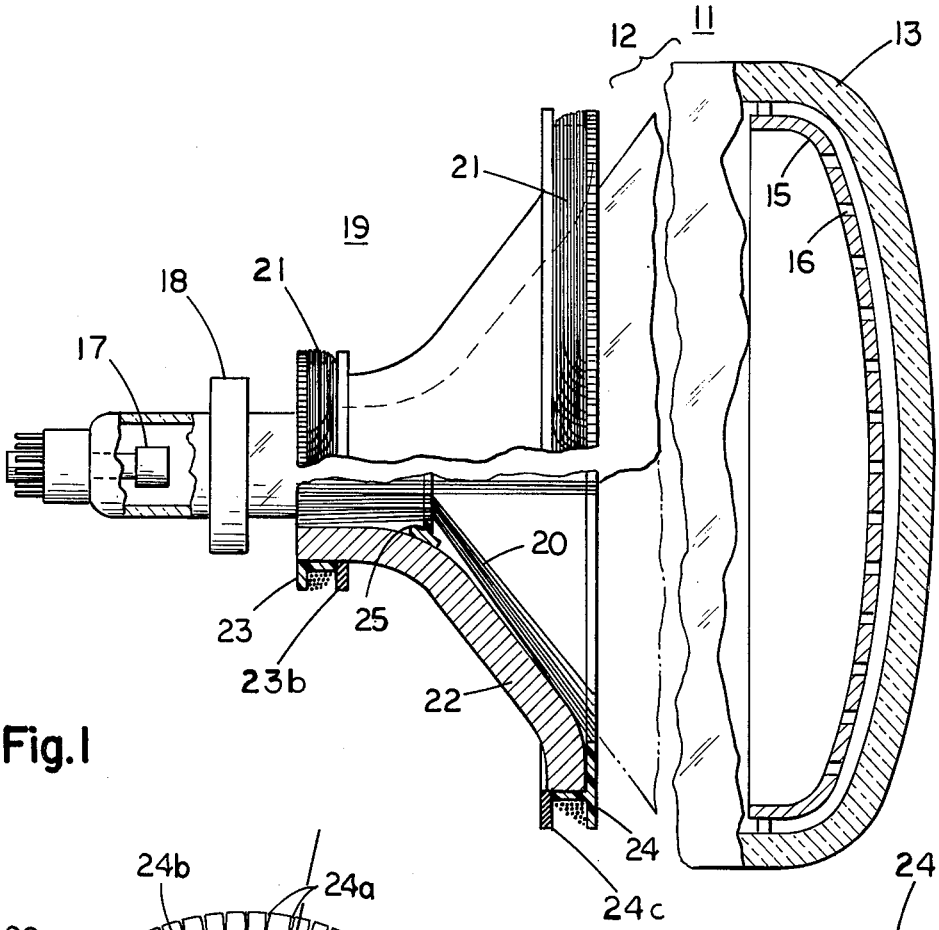
FIG. 1 is a partial sectional view of a television picture tube and a deflection yoke according to the invention.

In FIG. 1, a glass envelope 12 of a color television picture tube 11 includes a glass faceplate portion 13 extending over the front of the picture tube forming a viewing screen. Spaced relatively closely behind the faceplate within the glass envelope is an aperture mask 15 containing a plurality of apertures 16 through which portions of electron beams pass to impinge on red, blue and green color phosphors disposed on the inside surface of faceplate 13. At the other end of picture tube 11 a neck portion encloses an electron gun assembly 17. Disposed around the outside of the neck portion is a static convergence and purity assembly 18. Disposed about the neck region and funnel-shaped portion of picture tube 11 is a deflection yoke 19 according to the invention. Deflection yoke 19 comprises an annular ferrite core member 22 containing a plurality of turns of a conductor 20 which forms horizontal and vertical deflection coils which, when suitably energized by scanning currents at the line and field deflection rate, causes the electron beams emitted by electron gun assembly 17 to scan a raster on the inside of faceplate 13.

Conductor 20 forms the active magnetic field producing turns on the inside of the deflection yoke; the return conductors are illustrated by conductor turns 21 shown illustrated in FIG. 1 as being returned in a saddle coil type manner. Active conductor turns 20 are held in place at the entrance region of the deflection yoke by grooves in an annular ring member 23. Grooves in an annular ring member 24 at the exit portion of core 22 hold the conductor turns 20 in place at the end of the core. Disposed around the inside circumference of core 22 at a position between the entrance and exit portions of the core is a third annular ring member 25, grooves in which further fix the position of individual turns of conductor 20 at this intermediate transverse plane of the ferrite core 22.

Figure 2:
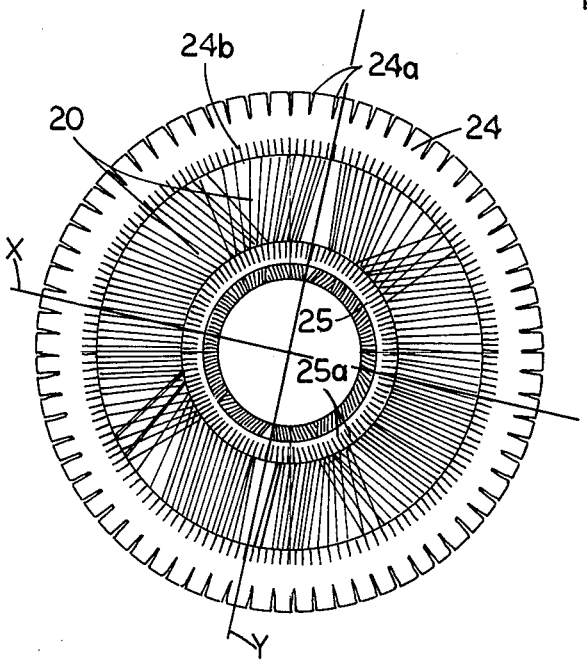
FIG. 2 is a front view of the deflection yoke illustrated in FIG. 1.

FIG. 2 is a front view of the deflection yoke illustrated in FIG. 1 showing the active conductor turns 20. Also illustrated more clearly is the front ring member 24 which includes a plurality of spaced grooves 24a on the outer perimeter of the ring and a plurality of spaced grooves 24b extending along the inner perimeter of ring 24. Annular ring member 24 containing the grooves 24a and 24b may be of any suitable material such as a plastic which can be molded or machined to fit about the exit portion of the core 22. Member 24 may be dimensioned such that a press fit of it over core 22 will suffice to fixedly retain the core and the member relative to each other. Alternatively, member 24 may be fixedly retained about the entrance potion of core 22 by any suitable bonding agent, such as epoxy.

Also illustrated in FIG. 2 is the intermediate ring member 25 containing a plurality of grooves 25a. Member 25 is fixedly retained at the desired position adjacent to the core 22 by a suitable bonding agent.

Figure 3:
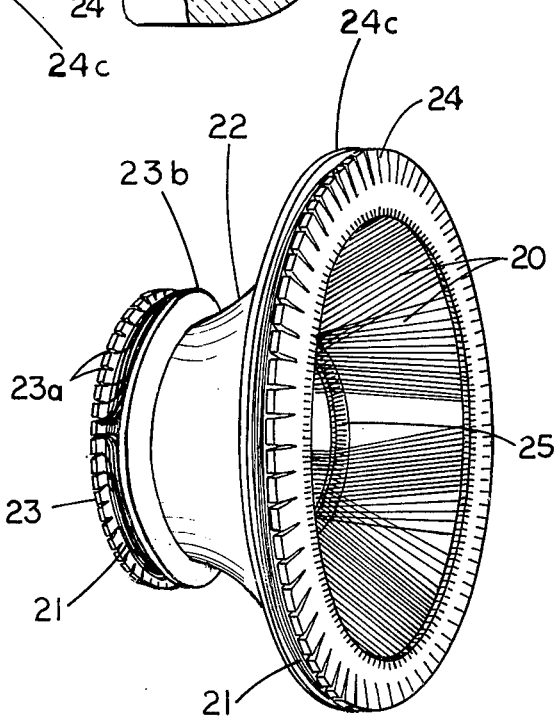
FIG. 3 is a perspective view of the deflection yoke illustrated in FIGS. 1 and 2.

Not illustrated in FIG. 2 but clearly illustrated in FIG. 3 is the annular ring member 23 containing a plurality of grooves 23*a* and a back member 23*b* which form a channel to contain the return conductor portions 21. This ring member, similar to the front ring member 24, is fixedly mounted at the rear portion of core 22. In FIG. 3, a back member 24*c* is molded to the ring member 24 to form a channel to contain the return conductors. FIGS. 2 and 3 illustrate the placement of the turns of active field producing conductor 20 between the front and rear portions along the inside surface of core 22.

As used herein, a "radial" conductor turn is one which would lie in a plane including the central longitudinal axis of the ferrite core and a "nonradial" conductor turn is one that would not lie in such a plane.

It is noted that turns of conductor 20 follow nonradial paths between the front and rear or exit and entrance portions of the core and deflection yoke 19. From a given position at the rear of the yoke as determined by the conductor being retained by a given groove 23*a*, the conductor is then brought to a desired groove 25*a* at an intermediate point along the inside of core 22 to determine a first nonradial path of the conductor. This conductor is then brought from the particular groove 25*a* to a desired groove 24*b* at the front or exit portion of deflection yoke 19, forming a second segment of the active conductor path which segment is also nonradial and extends along a different direction than the first portion of the path. As will be described subsequently, as many of the conductor turns 20 of the vertical and horizontal deflection coils may be positioned and retained along these double segment nonradial paths as required to produce a desired net deflection field. It is to be understood that some of the conductor turns may be disposed radially as in conventional deflection yokes, or may be radial for one portion such as between annular members 23 and 25 and nonradial for the segment extending between annular members 25 and 24.

In FIGS. 1 and 3 the return conductors are returned in a saddle type deflection coil arrangement, which return conductors form transverse groups of conductors 21 at the exit end of the deflection yoke and similar transverse conductor turns at the entrance portion of the deflection yoke. As illustrated in FIGS. 2 and 3, the groove arrangement may take the form of relatively closely spaced grooves 24*b* which provide the relatively small incremental circumferential positioning of the conductors at the exit portion of the yoke. From the exit portion, or grooves 24*b*, the conductors become return conductors and, hence, several conductors form several separate grooves 24*b* may all pass through a single groove 24*a* for convenience in forming the return conductor portion of the deflection coils. It is to be understood that instead of having separate grooves 24*a*, grooves 24*b* may simply extend the full width of annular member 24. The important consideration is that the grooves 24*b* provide for precision positioning and retention of each of active conductor turns 20.

Figure 4:
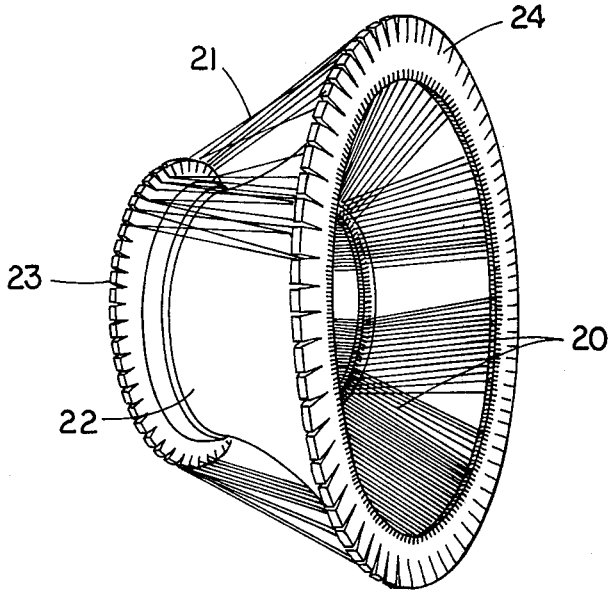
FIG. 4 is a perspective view of a toroidal deflection yoke in accordance with the invention.

FIG. 4 is a perspective view of a toroidal deflection yoke embodying the invention. The deflection yoke of FIG. 4 differs essentially from that of FIGS. 1, 2 and 3 in that the return conductors 21 are returned in a toroidal manner, i.e., returned from the front ring member 24 to the rear ring member 23 for each active conductor turn 20. It is noted that no molded back members 23*b* and 24*c* are utilized in the toroidal embodiment of the yoke due to the different return conductor arrangement. The active conductor turns 20 can form the same winding distribution whether the toroidal version as in FIG. 4 or the saddle type version is utilized. The main considerations in determining which form of return conductors is used would be the effect of the fringe magnetic fields generated by the return conductors and the type of coil winding machine which is available to most efficiently wind the desired conductor distribution. In some instances, a toroidal winding machine may be utilized more efficiently in that these machines can be programmed to rotate the deflection yoke core 22 in an angular motion as the conductor turns are being wound. This can provide for the automatic winding of the nonradial turns which are laid in the respective grooves of the front, intermediate and rear ring members as each turn is wound.

Figure 5:
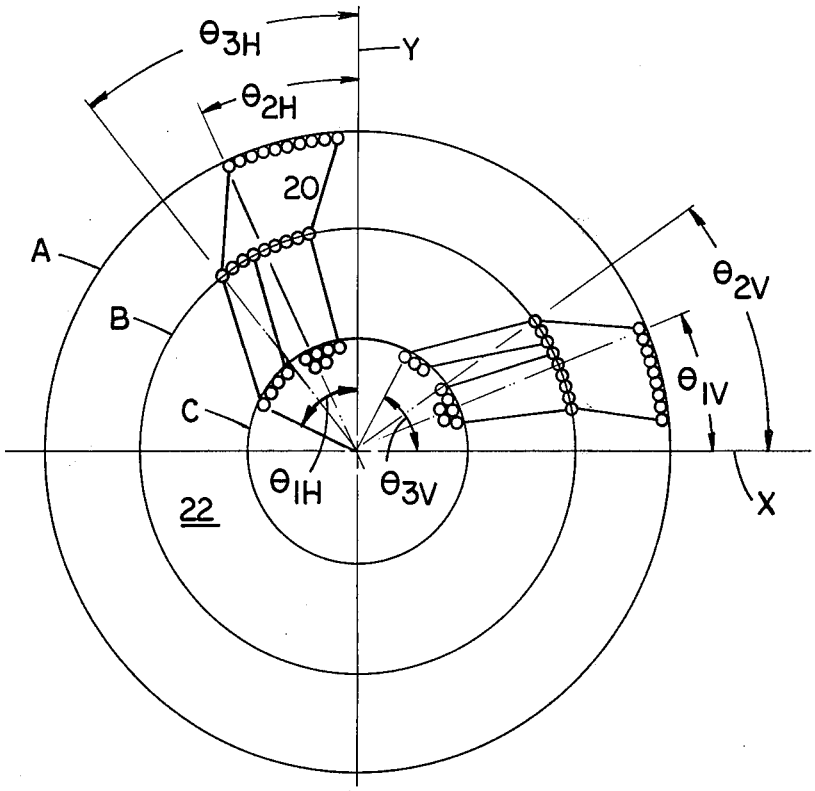
FIG. 5 illustrates a conductor winding distribution obtainable with a deflection yoke in accordance with the invention.

FIG. 5 illustrates in detail a portion of conductor winding distribution obtainable with a deflection yoke in accordance with the invention. As stated above, this winding distribution or any other desired winding distribution may utilize the toroidal form of winding or the saddle coil type winding. The first quadrant in FIG. 5 illustrates nine conductor turns illustrated at the rear, intermediate and forward portions at the inside surface of core 22, indicated at locations C, B and A, respectively. At the rear portion of the yoke with reference to the X-deflection axis, the outermost conductor subtends an angle $\theta_3$V. That same conductor at the intermediate point subtends an angle of $\theta_2$V and that same conductor at the front of the deflection yoke subtends an angle of $\theta_1$V. Because all of the angles are different, the conductor forms a double segment nonradial path between the rear and front portions of the deflection yoke. To illustrate the flexibility of the arrangement, conductors at the rear portion of the core 22 are shown in a dual layer for one portion and a second portion is shown not being contiguous with the first dual layer portion. This group of conductors is then engaged in grooves in the intermediate ring member to form a continuous contiguous single layer of conductors. A similar arrangement is shown at the forward large diameter portion of the core 22. Obviously, the particular distribution arrangement and the angles selected for the conductors at any of the three sets of grooves can be determined by the designer for a particular deflection yoke to be utilized with a particular cathode ray tube.

Also in FIG. 5, in the second quadrant an illustrative group of 10 horizontal coil conductor turns are shown fixedly retained in a particular conductor distribution at locations C at the rear of the yoke, B at an intermediate location in the yoke and A at the front or exit portion of the yoke. These horizontal conductors are also illustrated as subtending three different angles θ1H, θ2H, and θ3H at the different locations on the core. Again, the particular conductor distribution will be determined by the particular design requirements for a given display system.

As can be seen in FIGS. 2, 3 and 4, groups of conductors may overlap each other at different angles. For example, it may be desirable to wind the conductors making up the vertical deflection coils at considerably different angles than the conductors making up the horizontal deflection coils. The grooves in the annular ring members can be made deep enough to hold a plurality of conductor turns to permit this type of winding distribution.

The arrangement of the invention provides for the independent angular positioning relative to the horizontal and vertical deflection axis of each conductor turn at the rear, intermediate and front portions of the core. Thus, the winding distribution of a particular deflection yoke and the separate vertical and horizontal deflection coils making up that yoke readily can be wound to control the pincushion, astigmatism and coma characteristics of the deflection yoke with greater flexibility than has been heretofore provided by prior art arrangements. For example, it is recognized that altering the conductor distribution at the front portion of the deflection yoke has the greatest effect on pincushion correction. Altering the conductor distribution at the generally central region of the deflection yoke has the greatest effect on altering the astigmatism characteristics of the deflection yoke, which characteristics can be utilized to provide a selfconverging effect on the electron beams of the cathode ray tube. Also, it is known that altering the conductor distribution at the rear or small diameter portion of the deflection yoke has the greatest effect on altering the coma characteristic of the deflection yoke, which characteristic controls whether the raster formed by one beam may be smaller or larger than the rasters formed by the other two beams. The particular compromises to be made between the pincushion, astigmatism and coma characteristics will be different for different size and type of cathode ray tubes. However, a deflection yoke in accordance with the invention provides the required winding distribution capability for almost any desired deflection field.

What is claimed is:

1. A deflection yoke, conductors of which lie along nonradial paths with respect to the central longitudinal axis of said yoke, comprising:

an annular core;

first and second sets of grooves circumferentially spaced and disposed at the respective entrance and exit portions of said core;

a third set of circumferentially spaced grooves disposed about the inner surface of said core at a position between said entrance and exit portions of said core; and a conductor wound in a plurality of turns relative to said core for forming horizontal and vertical deflection coil portions, at least some of the conductor turns extending along the inside surface of said core engaging respective grooves of each of said first, second and third sets of said grooves for fixedly retaining said conductor turns along respective nonradial paths relative to said axis between said first and third and said third and second sets of grooves.

2. A deflection yoke according to claim 1 wherein said first and second sets of grooves are contained in first and second annular members disposed at the entrance and exit portions of said core.

3. A deflection yoke according to claim 2 wherein said third set of grooves is contained in a third annular member disposed adjacent to said inner surface of said core at a position between said entrance and exit portions of said core.

4. A deflection yoke according to claim 1 wherein said conductor is wound relative to said core for forming saddle-type deflection coils.

5. A deflection yoke according to claim 1 wherein said conductor is wound relative to said core for forming toroidal deflection coils.

* * * * *

Disclaimer 4,023,129.—*Jerrold Kerwin Kratz* and *Edward Walter Christensen, II,* Indianapolis, Ind. DEFLECTION YOKE WITH NON-RADIAL CONDUCTORS. Patent dated May 10, 1977. Disclaimer filed Nov. 12, 1981, by the assignee, *RCA Corp.*

Hereby enters this disclaimer to claims 1, 2, 3 and 5 of said patent.

[*Official Gazette January 26, 1982.*]